United States Patent [19]

Joo' et al.

[11] Patent Number: 4,529,494

[45] Date of Patent: Jul. 16, 1985

[54] BIPOLAR ELECTRODE FOR HALL-HEROULT ELECTROLYSIS

[75] Inventors: Louis A. Joo', Johnson City; Duane R. Secrist, Elizabethton; James M. Clark, Johnson City; Kenneth W. Tucker, Elizabethton; Jay R. Shaner, Johnson City, all of Tenn.

[73] Assignee: Great Lakes Carbon Corporation, New York, N.Y.

[21] Appl. No.: 611,496

[22] Filed: May 17, 1984

[51] Int. Cl.[3] ..... C25B 11/04; C25B 11/02

[52] U.S. Cl. ..... 204/290 R; 204/243 R; 204/268; 204/291; 204/292; 204/293; 427/250

[58] Field of Search ..... 204/280, 290 R, 291–294, 204/243 R, 268; 427/250

[56] References Cited

U.S. PATENT DOCUMENTS

| | | | |
|---|---|---|---|
| 4,017,375 | 4/1977 | Pohto | 204/268 |
| 4,138,324 | 2/1979 | Meyer | 204/268 |
| 4,339,323 | 7/1982 | Dilmore et al. | 204/268 |
| 4,402,809 | 9/1983 | Dilmore et al. | 204/268 |
| 4,422,917 | 12/1983 | Hayfield | 204/268 |

*Primary Examiner*—R. L. Andrews

*Attorney, Agent, or Firm*—Adrian J. Good

[57] ABSTRACT

A monolithic bipolar electrode for the production of primary aluminum by molten salt electrolysis is composed of a cermet anodic layer 10, a conductive and diffusion-resistant intermediate layer 14, and a refractory hard metal cathodic layer 20, with the edges covered by an electrolyte-resistant coating. The intermediate conductive layer 14 has a coefficient of thermal expansion intermediate to the anodic and cathodic layers.

16 Claims, 2 Drawing Figures

· FIG. 1 ·

BIPOLAR ELECTRODE FOR HALL-HEROULT ELECTROLYSIS

BACKGROUND OF THE INVENTION

1. Field of the Invention

The invention relates to the production of primary aluminum by molten salt electrolysis using a cermet anode, and a $TiB_2$, or $TiB_2$-graphite cathode in a bipolar electrode configuration.

2. Description of the Prior Art (a) The Hall-Heroult Cell

Aluminum is commercially produced by the electrolysis of alumina in molten cryolite using conductive carbon electrodes, with the overall reaction:

$$2Al_2O_3 + 3C \xrightarrow[Na_3AlF_6]{950^\circ\ C.,\ 4.5V.} 4Al + 3CO_2.$$

Typically the Hall cell is a shallow vessel, with the floor forming the cathode, the side walls a rammed coke-pitch mixture, and the anode a block suspended in the molten cryolite bath at an anode-cathode separation of a few centimeters. The anode is formed from a pitch-calcined petroleum coke blend, prebaked to form a monolithic block of amorphous carbon. The cathode is typically formed from a prebaked pitch-calcined anthracite or coke blend, with cast-in-place iron over steel bar electrical conductors in grooves in the bottom side of the cathode.

(b) The Anode

The problems caused by use of carbon anodes are related to the cost of the anode consumed in the above reaction and to the impurities introduced to the melt from the carbon source. The petroleum cokes used in the fabrication of the anodes generally have significant quantities of impurities, principally sulfur, silicon, vanadium, titanium, iron and nickel. Sulfur is oxidized to its oxides, causing troublesome workplace and environmental pollution problems. The metals, particularly vanadium, are undesirable as contaminants in the aluminum metal produced. Removal of excess quantities of the impurities requires extra and costly steps when high purity aluminum is to be produced.

Attempts have been made in the past to use non-consumable anodes with little apparent success. Metals either melt at the temperature of operation, or are attacked by oxygen and/or the cryolite bath. Ceramic compounds, such as oxides with perovskite and spinel crystal structures, usually have too high electrical resistance or are attacked by the cryolite bath.

Previous efforts in the field are disclosed in U.S. Pat. No. 3,718,550—Klein, Feb. 27, 1973, Cl. 204/67; U.S. Pat. No. 4,039,401—Yamada et al., Aug. 2, 1977, Cl. 204/67; U.S. Pat. No. 4,098,669—de Nora et al., July 4, 1978, Cl. 204/252; Belyaev+Studentsov, *Legkie Metal* 6, No. 3, 17–24 (1937), (C.A. 31 [1937], 8384) and Belyaev, *Legkie Metal* 7, No. 1, 7–20 (1938) (C.A. 32 [1938], 6553).

Of the above references, Klein discloses an anode of at least 80% $SnO_2$, with additions of $Fe_2O_3$, ZnO, $Cr_2O_3$, $Sb_2O_3$, $Bi_2O_3$, $V_2O_5$, $Ta_2O_5$, $Nb_2O_5$ or $WO_3$. Yamada discloses spinel structure oxides of the general formula $XYY'O_4$ and perovskite structure oxides of the general formula $RMO_3$, including the compounds $CoCr_2O_4$, $TiFe_2O_4$, $NiCr_2O_4$, $NiCo_2O_4$, $LaCrO_3$, and $LaNiO_3$. Balyaev discloses anodes of $Fe_2O_3$, $SnO_2$, $Co_3O_4$, NiO, ZnO, CuO, $Cr_2O_3$ mixtures thereof as ferrites. De Nora discloses $Y_2O_3$ with Y, Zr, Sn, Cr, Mo, Ta, W, Co, Ni, Fd, Ag, and oxides of Mn, Rh, Ir, and Ru.

Problems with the materials above are related to the poor corrosion resistance of the materials, the cost of the raw materials, the fragility of the electrodes, the difficulty of making a sufficiently large electrode for commercial usage, and the low electrical conductivity of many of the materials when compared to carbon anodes.

U.K. Patent application No. 2,069,529, published Aug. 26, 1981 (and related U.K. Patent application No. 2,078,259, published Jan. 6, 1982), discloses cermet anodes useful for electrowinning metals from fused salt baths, such as aluminum from fused cryolite-alumina, which are composed of a ceramic phase and a metallic phase selected from a limited number of oxides and metals. The ceramic phase includes oxides such as ferrites and chromites of manganese, iron, cobalt, nickel, copper and zinc, and the metallic phase is selected from the metals chromium, iron, cobalt, nickel, copper and noble metals. The amount of metal phase incorporated in these cermets varies from about 2% to 30% by volume, preferably 10% to 20%. Reference is also made to U.S. Pat. No. 4,397,729, issued Aug. 9, 1983 (filed Jan. 16, 1981) to Duruz et al.; U.S. Pat. No. 4,374,050, issued Feb. 15, 1983 (filed Nov. 10, 1980) to Ray; U.S. Pat. No. 4,374,761, issued Feb. 22, 1983 (filed Nov. 10, 1980) to Ray, which concern cermet anodes for electrowinning metals from fused salts; and Ser. No. 475,951, Secrist et al., discloses a cermet anode assembly; Ser. Nos. 491,089 and 554,068, Secrist et al., disclose a cermet anode; Ser. No. 540,885, Landon et al. discloses an anode composition; Ser. No. 559,723, Grindstaff et al., discloses a method of producing aluminum alloys using cermet anodes; Ser. No. 560,456, Secrist et al., discloses a cermet electrode assembly.

(c) The Cathode

During operation of the Hall cell, only about 25% of the electricity consumed is used for the actual reduction of alumina to aluminum, with approximately 40% of the energy consumed by the voltage drop across the bath. The anode-cathode spacing is usually about 4–5 cm., and attempts to lower this distance result in an electrical discharge from the cathode to the anode through aluminum droplets.

The molten aluminum is present as a pad in the cell, but is not a quiescent pool due to the factors of preferential wetting of the carbon cathode surface by the cryolite melt in relation to the molten aluminum, causing the aluminum to form droplets, and the erratic movements of the molten aluminum from the strong electromagnetic forces generated by the high current density.

Typically, amorphous carbon is a low energy surface, but also is quite durable, lasting for several years duration as a cathode, and relatively inexpensive. However, a cathode or a cathode component such as $TiB_2$ stud which has better wettability would permit closer anode-cathode spacing.

It had previously been known that refractory hard metals (RHM) are useful as a cathode component in the electrolytic production of aluminum, when retrofitted in the Hall cell as a replacement for the carbon or semi-graphite form. If the anode-cathode (A–C) distance could be lowered, the % savings in electricity would be as follows:

| A–C distance | % savings |
|---|---|
| 3.8 cm. | std. |
| 1.9 cm. | 20% |
| 1.3 cm. | 27% |
| 1.0 cm. | 30% |

Refractory hard metals (RHM) as a class are hard, dense materials with high melting points, and are generally of low solubility and resistant to corrosive attack by most acids and alkalis. They also have high electrical conductivity due to their metallic structure; consequently, this combination of properties has made them important candidates for use as cathodes in molten salt electrolysis processes where their corrosion resistance and conductivity are vital properties needed for economical performance.

RHM articles have been produced by a number of processes including hot pressing of the granular or powdered materials, chemical vapor deposition, and in situ reduction of metals by carbon or other reducing agents. Hot pressing is the most commonly used process for the production of shapes. A die and cavity mold set is filled with powder, heated to about 300°–800° C., and placed under pressure of about $2\times10^8$ Pa to produce a preform. The preform is then removed from the mold and heated at about 1500°–2000° C., or higher to increase density.

Hot pressing has the limitations of applicability to simple shapes only, erosion of the mold, and slow production. The pieces produced by hot pressing are subject to a high percentage of breakage in handling, making this process expensive in terms of yield of useful products.

The RHMs of most interest include the carbides, borides, and nitrides of the metals of Groups IVA, IVB, VB, and VIB of the periodic table, particularly Ti, V, Si, and W. Of these, the borides are of most interest as electrodes in high temperature electrolysis applications due to their electrical conductivity, and of the borides, $TiB_2$ has been extensively investigated for use as a cathode or cathodic element in the Hall-Heroult cell.

Several workers in the field have developed refractory high free energy material cathodes. U.S. Pat. No. 2,915,442, Lewis, Dec. 1, 1959, claims a process for production of aluminum using a cathode consisting of the borides, carbides, and nitrides of Ti, Zr, V, Ta, Nb, and Hf. U.S. Pat. No. 3,028,324, Ransley, Apr. 3, 1962, claims a method of producing aluminum using a mixture of TiC and $TiB_2$ as the cathode. U.S. Pat. No. 3,151,053, Lewis, Sept. 29, 1964, claims a Hall cell cathode conducting element consisting of one of the carbides and borides of Ti, Zr, Ta and Nb. U.S. Pat. No. 3,156,639, Kibby, Nov. 10, 1964, claims a cathode for a Hall cell with a cap of refractory hard metal and discloses $TiB_2$ as the material of construction. U.S. Pat. No. 3,314,876, Ransley, Apr. 18, 1967, discloses the use of $TiB_2$ for use in Hall cell electrodes. The raw materials must be of high purity particularly in regard to oxygen content, Col. 1, line 73-Col. 2, line 29; Col. 4, lines 39–50, Col. 8, lines 1–24. U.S. Pat. No. 3,400,061, Lewis, Sept. 3, 1968 discloses a cathode comprising a refractory hard metal and carbon, which may be formed in a one-step reaction during calcination. U.S. Pat. No. 4,071,420, Foster, Jan. 31, 1978, discloses a cell for the electrolysis of a metal component in a molten electrolyte using a cathode with refractory hard metal $TiB_2$ tubular elements protruding into the electrolyte. Ser. No. 043,242, Kaplan et al. (Def. Pub.), filed May 29, 1979, discloses Hall cell bottoms of $TiB_2$. EPA 042658 discloses RHM cathodic elements. The principal deterrent to the use of a RHM as a Hall cell cathode has been the sensitivity to thermal shock and the great cost, as compared to the traditional carbonaceous compositions. U.S. Pat. No. 4,376,029, Joo' et al., discloses $TiB_2$-graphite composites used as cathodes; also U.S. Pat. No. 4,377,463, Joo' et al.; U.S. Pat. No. 4,439,382, Joo' et al., and Ser. No. 287,129, Juel et al., co-pending.

(d) Bipolar Technology

The ultimate end of the developments above is the use of long-lasting or relatively permanent anode and cathode materials in bipolar electrodes in a modified Hall-Heroult cell specially designed to make maximum use of the permanence of both components and the wettability of the cathodic component to produce the most energy and labor efficient and non-polluting cell possible.

It is generally accepted that aluminum could be produced most efficiently in a Hall-Heroult type cell equipped with dimensionally stable bipolar electrodes. Such a cell, with the electrodes deployed in closely-spaced vertical or horizontal arrays, should operate with the lowest energy requirement and demand less capital outlay per unit of aluminum production due to the high electrode packing density.

Bipolar electrodes of various design and composition have been disclosed by several workers. U.S. Pat. No. 4,187,155, DeNora, Feb. 5, 1980, discloses an anode and a bipolar electrode comprised of an oxy-compound of at least one metal from the group of La, Tb, Er, Yb, Th, Ti, Zr, Hf, Nb, Cr and Ta, an electroconductive agent, and a surface catalyst.

U.S. Pat. No. 4,111,765, DeNora et al., Sept. 5, 1978, discloses sintered electrodes having 40–90% of valve metal boride, 5–40% of SiC, and 5–40% of C. A bipolar electrode using these materials is disclosed at column 5, lines 36–54. It has been the experience of the inventors that such refractory hard metals are rapidly attacked when used as anodes and are primarily useful as cathodic elements.

U.S. Pat. No. 3,930,967, Alder, discloses vertically propagated cells having an advantage of easy transport of metal to a single sump using the same channels provided for bath circulation. A major shortcoming of the bipolar assembly described is the unacceptable contact resistance observed for this configuration since the components are clamped together only by mechanical pressure.

U.S. Pat. No. 4,347,050, Ray, discloses a bipolar electrode having an anode comprising two oxides, e.g. NiO and $Fe_2O_3$, a metal separator, e.g. Ni, or stainless steel, and a $TiB_2$ cathode. U.S. Pat. No. 4,374,764, Ray, discloses a bipolar electrode composed of a ceramic anode and a carbon or $TiB_2$ cathode separated by Ni, Fe or Cr alloys.

The major technical problems to be addressed in the development of a bipolar electrode are:

1. fabricating anode and cathode materials with dissimilar expansion coefficients into a monolithic structure which will exhibit low ohmic losses, 2. maintaining acceptable internal stability of the electrode during extended cell operation at 950° C., and 3. protecting the perimeter of the anode/cathode interface from attack by melt constituents.

SUMMARY OF THE INVENTION

Our invention is a monolithic bipolar electrode wherein these problems are overcome. The electrode is fabricated from cathode and anode elements joined to one or more electrically conductive intermediate materials which have expansion coefficients between those of the anode and cathode and which, during cell operation, function as diffusion barriers to preclude redox reactions from taking place between the cathode and anode constituents. The cathode material is selected from (1) the borides and carbides of Group IVA (Ti, Zr, Hf), VA (Nb, Ta), VIA (Cr, Mo, W); (2) from composites formed from these borides and carbides in combination with AlN, BN, SiC or C, or (3) carbon or graphite in combination with one or more of the above. The preferred cathode materials are $TiB_2$ and $TiB_2$/graphite composites. The preferred anode material is an oxide-based cermet containing as the ceramic phase spinel, hexagonal or magnetoplumbite ferrites and as the metal phase Ni, Fe, Cu and alloys or mixtures thereof.

The expansion coefficients of the cathode and anode elements, approximately $7\text{-}8\times10^{-6}$/°C. and $12\text{-}14\times10^{-6}$/°C. @950° C., respectively, do not permit joining of the elements directly, thus materials with CTE's in the range of $9\text{-}12\times10^{-6}$/°C. are employed as intermediate layers. The monolithic electrode is formed by brazing sintered anode and cathode elements to one or more intermediate members. The thickness of the intermediate member or members is determined by the rate of counter diffusion of the various chemical elements comprising the electrode. This method of fabricating the electrode imposes an additional constraint on the anode and cathode materials in that they must be rendered wettable for the brazing operation. This is accomplished in the anode by a metal content of at least 30% by volume at the interface. To facilitate the connection to an intermediate layer, the composition of the anode has a gradient, the side exposed to the electrolyte having from about 10 to 25% by volume of metal and from 75 to 90% by volume of ceramic while the side brazed to the intermediate layer has from about 30% or more by volume of metal and up to 70% by volume of ceramic component. The anode is most conveniently made by filling a mold in stages with powders or slips having the gradient compositions, then pressing and firing the pieces, as in co-pending Ser. No. 491,089 now U.S. Pat. No. 4,472,258. The cathode can likewise have a gradient composition, but better results have been obtained by metallizing the portion of the cathode to be brazed with a ductile metal such as Ni via chemical vapor deposition (CVD) coating, plating, vacuum deposition or other known techniques. The high CTE of the metallized coating is not detrimental provided the thickness of the coating does not exceed 0.5 mm. (20 mils). If $TiB_2$ is chosen as the active cathode material, the cathode element must be graded in the direction of the braze interface with carbon or other suitable material to form a composition which is not wetted by liquid aluminum so that aluminum does not penetrate the cathode during cell operation and attack the interface region. FIG. 1 illustrates the layering sequence of an electrode assembly.

The brazing operation should be carried out at a temperature at least 100° C. above the cell operating temperature of 950° C., i.e., the melting point of the braze should be >1050° C. The braze alloy must also be chemically compatible with the intermediate conductive member and the individual anode and cathode elements. Materials found to be useful for this purpose are alloys containing one or more of copper, nickel, or iron and brazing foils manufactured by Metglas®. The MBF-75/75A, MBF-80/80A, and MBF-90/90A are the preferred grades of Metglas® foil.

The exposed joint at the perimeter of the electrode is protected from the melt constituents by a layer of one or more of BN, $Si_3N_4$, SiC, electromelted MgO, or silicon aluminum oxynitride. The layer must be dense and can be applied via, e.g. the CVD process.

The electrode produced in this fashion is a monolithic structure and, as such, possesses high mechanical integrity and strength. It has a low electrical resistivity at the operating temperature of the cell and thus contributes only a small ohmic loss, enabling the cell to operate at high energy efficiency. It has high corrosion resistance on both the anodic and cathodic sides of the electrode, and is resistant to attack on the perimeter by the molten bath.

DESCRIPTION OF THE PREFERRED EMBODIMENT

EXAMPLE 1

To demonstrate the integrity of the anode/intermediate member/cathode joint region, the following model was fabricated as follows.

A nominal 2.5 cm (1") diameter cylinder was prepared from pure $TiB_2$ powder by filling a graphite mold by gravity, vibrating the mold to remove voids, and sintering all at atmospheric pressure at 2215° C. in Argon. The apparent density of the cylinder was 2.85 g/cm$^3$. Several disks 0.64 cm (~0.25") thick were sectioned from the cylinder and CVD coated on one face with 0.1 mm (~4 mils) of Ni.

A dense 1.9 cm ($\frac{3}{4}$") diameter pellet of 40% by volume Ni/60% by volume $(MnZn)Fe_{2.04}O_4$ cermet was formed by dry blending Ni powder with MnZn ferrite powder (prepared by calcining a mixture of $MnCO_3$, ZnO and $Fe_2O_3$), isostatically molding a green pellet at $1.4\times10^8$ Pa (20,000 psi) and sintering the pellet at 1225° C. for 6 hours in vacuum. Disks 1.3 cm (0.5") thick were cut for the pellet.

A Ni-coated $TiB_2$ disk and a cermet disk were brazed to opposite sides of a 0.7 mm (30 mil) thick Kovar® disk (54 wt. % Fe, 29 wt. % Ni, 17 wt. % Co and CTE of $11\text{-}12\times10^{-6}$/°C. @950° C.) with MBF® 80/80A brazing foil obtained from Metglas having the composition 80.8 wt. % Ni, 15.2 wt. % Cr, 4.0 wt. % B. The components were stacked as shown in FIG. 1 and the brazing operation carried out at 1090° C. in vacuum. Examination of the sample after sectioning showed that the components were joined securely at the two interfaces with no evidence of cracking or separation. FIG. 2 shows electron micrographs of the interface region superimposed with x-ray line scans for Fe and Ti. Diffusion of Ti from the cathode into the Kovar® layer is apparent.

EXAMPLE 2

This example illustrates the method used in our laboratory to fabricate cermet anodes, one end of which functions as the active electrode composition, while the other end is brazed to a metal current member.

A composite cermet anode component was fabricated as follows: Two cermet compositions were prepared, one a 16 vol. % Ni/84 vol. % $NiFe_{2.04}O_4$ cermet to function as the active anode material and the other a 40 vol. % Ni/60 vol. % $NiFe_{2.04}O_4$ cermet to function as the brazable material. The powders were mixed by dry blending nickel powder with Ni ferrite powder prepared by calcining a mixture or $NiCO_3$ and $Fe_2O_3$ for two hours at 900° C. in air. A small pellet of the 40 vol. % Ni/60 vol. % $NiFe_{2.04}O_4$ was first produced by isostatically molding the cermet powder at 103 MPa. The pellet was placed in a mold and the remainder of the mold filled with the 16 vol. % Ni/84 vol. % $NiFe_{2.04}O_4$ powder such that the powder surrounded all but one end of the pellet. The powder and encased pellet were then pressed at 124 MPa to form a cylindrical anode preform with a brazable insert. The sample was then sintered for 30 hours at 1325° C. in vacuum to produce an anode of variable composition measuring approximately 3.25 cm in diameter and 7.25 cm in length.

Figure 1:
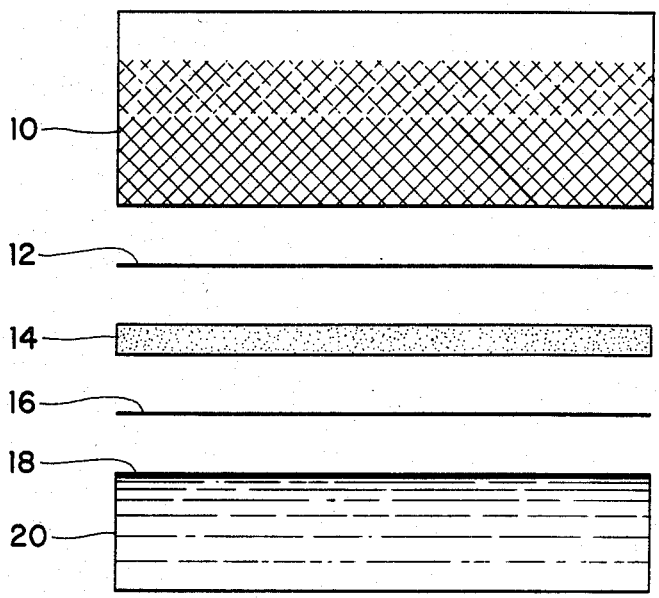
FIG. 1 is an expanded representation of the electrode with anode 10 having a gradient composition, brazing material 12 and 16, intermediate conductive layer 14, and cathode 20 with metallized coating 18.
Figure 2:
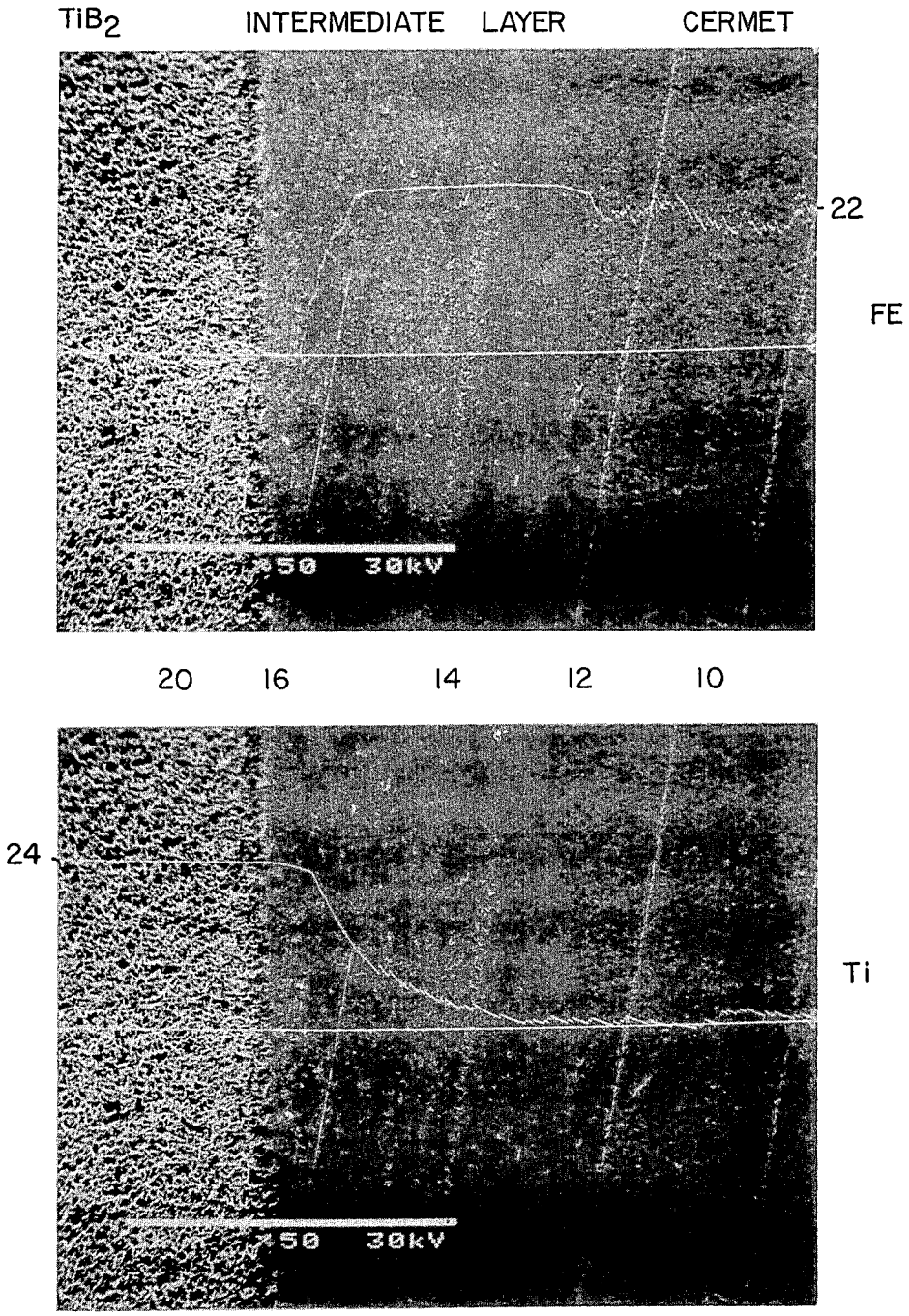
FIG. 2 shows two electron micrographs of an electrode of the invention showing cathode 20, brazed joints 12 and 16, intermediate conductor 14, and anode 10. The two traces 22 and 24 show the concentrations of Fe in 2A and Ti in 2B with no Fe in the cathode, a large amount in the intermediate layer, and slightly less in the MnZn ferrite anode, and a large arount of Ti in the cathode diffused into the intermediate layer.

We claim:

1. A monolithic bipolar electrode for a molten salt electrolytic cell having an anode and a cathode separated by and brazed to an electrical conductive intermediate layer, said intermediate layer having a thermal expansion coefficient intermediate to those of said anode and cathode.

2. A monolithic bipolar electrode for a molten salt electrolytic cell having an anode and a cathode separated by and brazed to an electrically conductive intermediate layer, said intermediate layer having a thermal expansion coefficient intermediate to those of said anode and cathode wherein the cathode is selected from the group consisting of the borides and carbides of Group IVA, VA or VIA metals of the Periodic Table or composites of said borides or carbides in combination with AlN, BN, SiC, carbon or graphite.

3. A monolithic bipolar electrode for a molten salt electrolytic cell having an anode and a cathode separated by and brazed to an electrically conductive intermediate layer, said intermediate layer having a thermal expansion coefficient intermediate to those of said anode and cathode wherein the anode is a cermet comprising a metal and a metal oxide selected from the group consisting of spinel, hexagonal and magnetoplumbite ferrites or mixtures or combinations thereof.

4. A monolithic bipolar electrode for a molten salt electrolytic cell having an anode and a cathode separated by and brazed to an electrically conductive intermediate layer, said intermediate layer having a thermal expansion coefficient intermediate to those of said anode and cathode wherein the anode is a cermet comprising metal oxide and a metal selected from the group consisting of Ni, Cu, and Fe or alloys or mixtures thereof.

5. The electrode of claim 1 wherein the electrical conductor intermediate layer has a CTE of 9 to $12\times10^{-6}$/°C., the cathode element has a CTE of 7 to $8\times10^{-6}$/°C. and the anode has a CTE of 12 to $14\times10^{-6}$/°C. at 950° C.

6. A monolithic bipolar electrode for a molten salt electrolytic cell having an anode and a cathode separated by and brazed to an electrically conductive intermediate layer, said intermediate layer having a thermal expansion coefficient intermediate to those of said anode and cathode wherein the anode has a gradient composition, the side exposed to the molten electrolyte having from 10 to 25% by volume metal and the side brazed to the intermediate layer having at least 30% by volume metal with the remainder being an oxide selected from the group consisting of spinel, hexagonal and magnetoplumbite ferrites.

7. A monolithic bipolar electrode for a molten salt electrolytic cell having an anode and a cathode separated by and brazed to an electrically conductive intermediate layer, said intermediate layer having a thermal expansion coefficient intermediate to those of said anode and cathode wherein the intermediate layer conductor is a Kovar ® alloy having the nominal composition 54 wt. % Fe, 29 wt. % Ni, 17 wt. % Co, and a CTE of $11\text{-}12\times10^{-6}$/°C. at 950° C.

8. The electrode of claim 1 wherein the anode and the cathode are brazed to the intermediate layer conductor by a brazing foil.

9. A monolithic bipolar electrode for a molten salt electrolytic cell having an anode and a cathode separated by and brazed to an electrically conductive intermediate layer, said intermediate layer having a thermal expansion coefficient intermediate to those of said anode and cathode wherein the anode and the cathode are brazed to the intermediate layer with a brazing foil having the composition 80.8 wt. % Ni, 15.2 wt. % Cr, 4 wt. % B.

10. The electrode of claim 1 wherein the cathode area to be brazed to the intermediate conductor is metallized with a ductile metal before brazing.

11. A monolithic bipolar electrode for a molten salt electrolytic cell having an anode and a cathode separated by and brazed to an electrically conductive intermediate layer, said intermediate layer having a thermal expansion coefficient intermediate to those of said anode and cathode wherein the cathode area to be brazed to the intermediate conductor is metallized with Ni by a chemical vapor deposition process.

12. A monolithic bipolar electrode for a molten salt electrolytic cell having an anode and a cathode separated by and brazed to an electrically conductive intermediate layer, said intermediate layer having a thermal expansion coefficient intermediate to those of said anode and cathode wherein the ceramic component of the anode comprises $(MnZn)Fe_{2.04}O_4$ or $NiFe_{2.04}O_4$.

13. A monolithic bipolar electrode for a molten salt electrolytic cell having an anode and a cathode separated by and brazed to an electrically conductive intermediate layer, said intermediate layer having a thermal expansion coefficient intermediate to those of said anode and cathode wherein the anode surface brazed to the intermediate conductor comprises 40% by volume Ni powder and 60% by volume $(MnZn)Fe_{2.04}O_4$ or $NiFe_{2.04}O_4$.

14. A monolithic bipolar electrode for a molten salt electrolytic cell having an anode and a cathode separated by and brazed to an electrically conductive intermediate layer, said intermediate layer having a thermal expansion coefficient intermediate to those of said anode and cathode wherein the cathode is $TiB_2$.

15. A monolithic bipolar electrode for a molten salt electrolytic cell having an anode and a cathode separated by and brazed to an electrically conductive intermediate layer, said intermediate layer having a thermal expansion coefficient intermediate to those of said anode and cathode wherein the anode is a cermet having a gradient composition, the area of said anode side in contact with the electrolyte having from 10 to 25% by volume of a metal selected from the group consisting of Fe, Cu and Ni and alloys and mixtures thereof and from 75 to 90% by volume of MnZn or Ni ferrite, the area of said anode side brazed to the intermediate conductor having at least 30% by volume of said metal and up to 70% by volume of said MnZn or Ni ferrite, said anode and the cathode brazed to said intermediate conductor with a brazing foil, said intermediate layer having the nominal composition 54 wt. % Fe, 29 wt. % Ni, 17 wt. % Co, said cathode comprising a material selected from the group consisting of $TiB_2$ and a $TiB_2$/carbon composite and being coated with Ni on the area brazed to said intermediate conductor, the exposed joint at the edge of said electrode protected by a layer of a material selected from the group consisting of BN, $Si_3N_4$, MgO, SiC, and silicon aluminum oxynitride.

16. A monolithic bipolar electrode for use in a modified Hall-Heroult cell having an anode side, an electrically conductive intermediate layer, and a cathode side, the improvement comprising said anode side being a cermet comprised of a metal selected from the group consisting of Fe, Cu, Ni and alloys or mixtures thereof and of a ceramic selected from the group consisting of spinel, hexagonal and magnetoplumbite ferrites and having a gradient composition with from 10 to 25% by volume of said metal at the area exposed to the electrolyte and at least 30% by volume of said metal at the interface between said anode and said intermediate layer with the remainder being said ceramic, said anode being brazed to said intermediate layer by a brazing foil, said intermediate layer having a coefficient of thermal expansion between the coefficients of thermal expansion of said anode and said cathode, said intermediate layer being brazed to said cathode by said brazing foil, said cathode being a material comprising $TiB_2$ and graphite and being coated in the area of the interface with said intermediate layer with a ductile metal, said cathode having a CTE of approximately 7 to $8\times10^{-6}$/°C. at 950° C., said anode having a CTE of approximately 12 to $14\times10^{-6}$/°C. at 950° C., said intermediate layer having a CTE of approximately 8 to $12\times10^{-6}$/°C. at 950° C., the interface edges between said anode and intermediate layer and between said cathode and intermediate layer and the perimeter of said electrode being covered by a material selected from the group consisting of BN, $Si_3N_4$, SiC, MgO and silicon aluminum oxynitride.

* * * * *